United States Patent [19]

Grummet

[11] Patent Number: 4,971,236

[45] Date of Patent: Nov. 20, 1990

[54] GUN HOLSTER

[75] Inventor: Don Grummet, Mississauga, Canada

[73] Assignee: Shield Corporation Inc., Oakville, Canada

[21] Appl. No.: 409,773

[22] Filed: Sep. 20, 1989

[51] Int. Cl.[5] ..... F41C 33/02

[52] U.S. Cl. ..... 224/243; 224/193; 224/912; 224/253

[58] Field of Search ..... 224/242, 243, 244, 193, 224/253, 912

[56] References Cited

U.S. PATENT DOCUMENTS

| | | | |
|---|---|---|---|
| 3,300,109 | 1/1967 | Clark | 224/253 |
| 4,218,000 | 8/1980 | Mixson | 224/193 |
| 4,270,680 | 6/1981 | Bianchi | 224/193 |
| 4,286,741 | 9/1981 | Rogers | 224/193 |
| 4,303,185 | 12/1981 | Shoemaker | 224/193 |
| 4,378,082 | 3/1983 | Chica | 224/243 |
| 4,542,841 | 9/1985 | Bianchi | 224/193 |

*Primary Examiner*—Linda J. Sholl

[57] ABSTRACT

The present invention provides a plastic gun holster having a break open front for drawing a revolver out of the holster. The holster further includes a strap which wraps from side to side of the holster and normally securing the break open front. The strap has one end which is releasably secured to the holster. The holster itself is provided with an upstanding strap release which forms part of the holster and which is used to push the strap off of the holster at its releasable end thereby enabling drawing of the revolver through the break open front.

3 Claims, 5 Drawing Sheets

GUN HOLSTER

FIELD OF THE INVENTION

The present invention relates to holsters of the front opening variety typically used by police forces and security guards.

BACKGROUND OF THE INVENTION

A front opening holster is one that is generally formed from a plastic casing with the casing having a front opening seam to allow rapid removal of a revolver through the front of the holster wich is particularly useful in emergency situations. It is however important that only the person wearing the holster be in a position to withdraw the revolver. For this reason, front opening holsters are additionally provided with means for locking the front opening against unauthorized use. Further means for releasing the holster must then be provided to allow use of the revolver as is necessary.

It is important that the front opening lock be inaccesible as much as possible to anyone other than the person wearing the holster. It is further important that the release for the lock be reliable at all times.

SUMMARY OF THE PRESENT INVENTION

The present invention provides a plastic gum holster having a break open front for drawing of the revolver with a strap wrapping from side to side of the holster across and securing the break open front. The strap is releasably secured at one end to the holster.

In accordance with the present invention, the holster itself is provided with a strap release forming an integral part of the plastic construction of the holster. The strap release is upwardly extending relative to the remainder of the holster adjacent to and for releasing the releasable end of the strap thereby enabling drawing of the revolver through the break open front of the holster.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
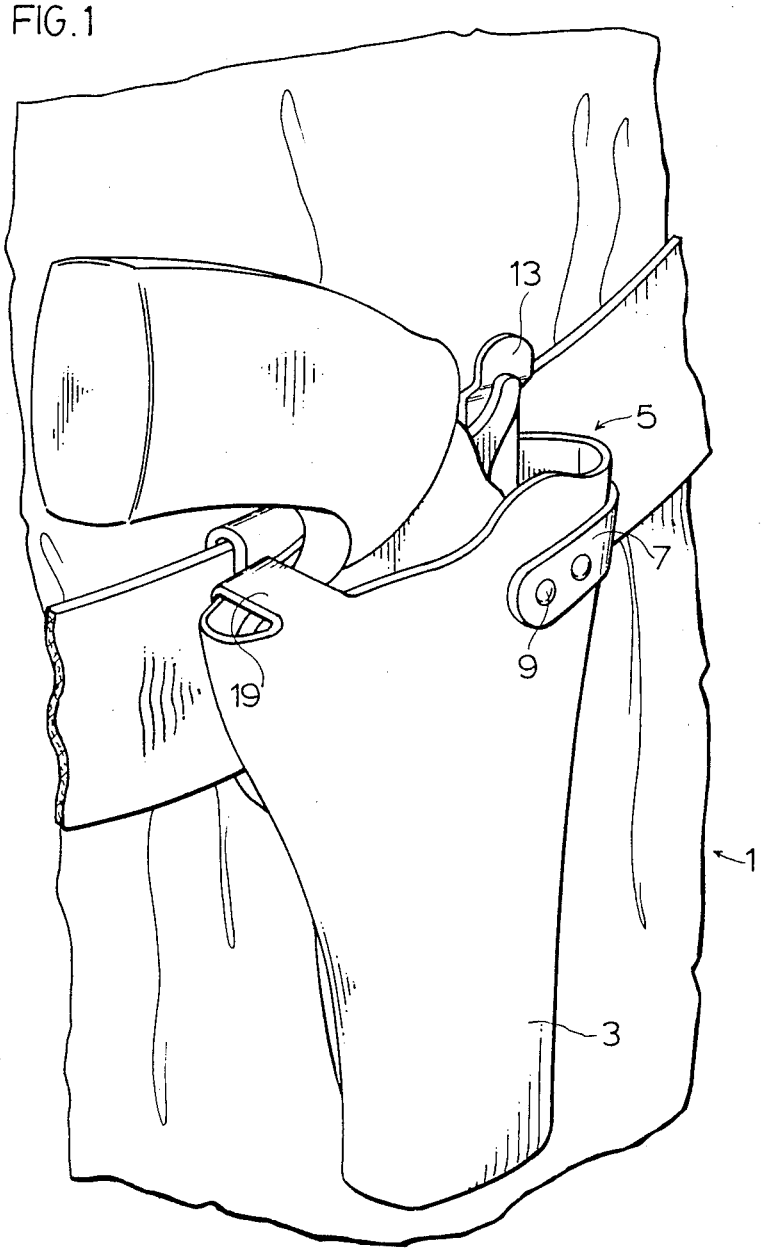
FIG. 1 is a perspective view of a revolver fitted in a holster according to a preferred embodiment of the present invention.

FIG. 1 shows a holster set up generally indicated at 1. This holster set up includes a main casing 3 in which a revolver is carried. The main casing has a unitary plastic construction with a break open front 5. The break open front is nothing more than a slit extending most of the way down the plastic casing as best seen in FIG. 3 of the drawings.

Figure 3:
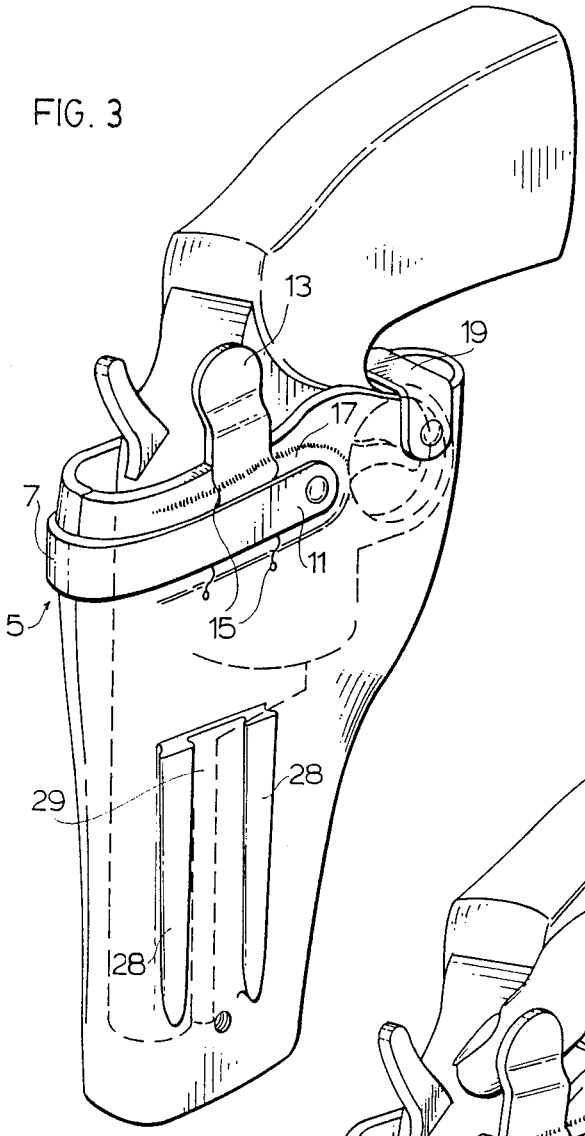
FIG. 3 is a front perspective view of the revolver and holster of FIG. 1.

Wrapping around the break open front of the holster is a securing strap 7 having a permanently mounted end 9 to the outside of the casing and a removably securable end 11 to the inside of the holster as seen in FIG. 3 of the drawings. Strap 7 when in its secured position prevents the front end of the holster from being opened.

Figure 5:
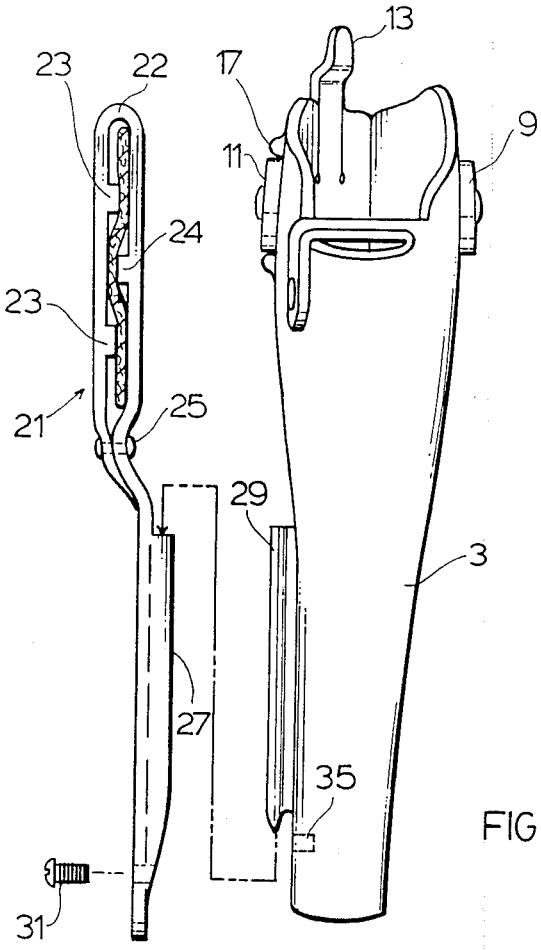
FIG. 5 is a rear view of the arrangement of FIG. 2.
Figure 6:
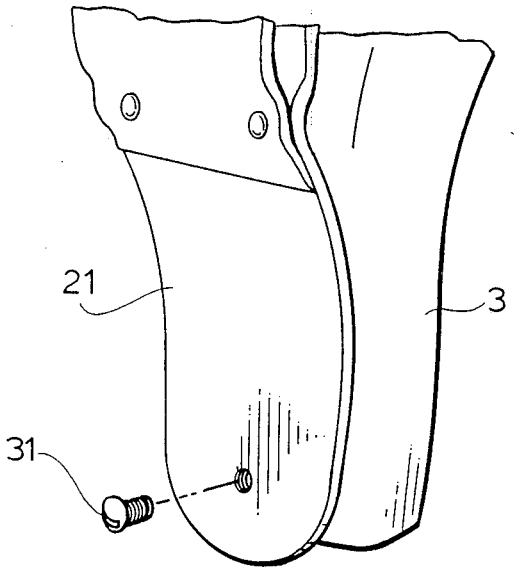
FIG. 6 is an enlarged perspective view of the lower end engagement between the holster and the holster support of FIG. 5 when assembled with one another.

Provided towards the back and extending across the top of the casing is a second strap 19. This strap is formed by an extension of the holster which is then bent down and secured to the other side of the holster as best seen in FIG. 5 of the drawings.

Figure 4:
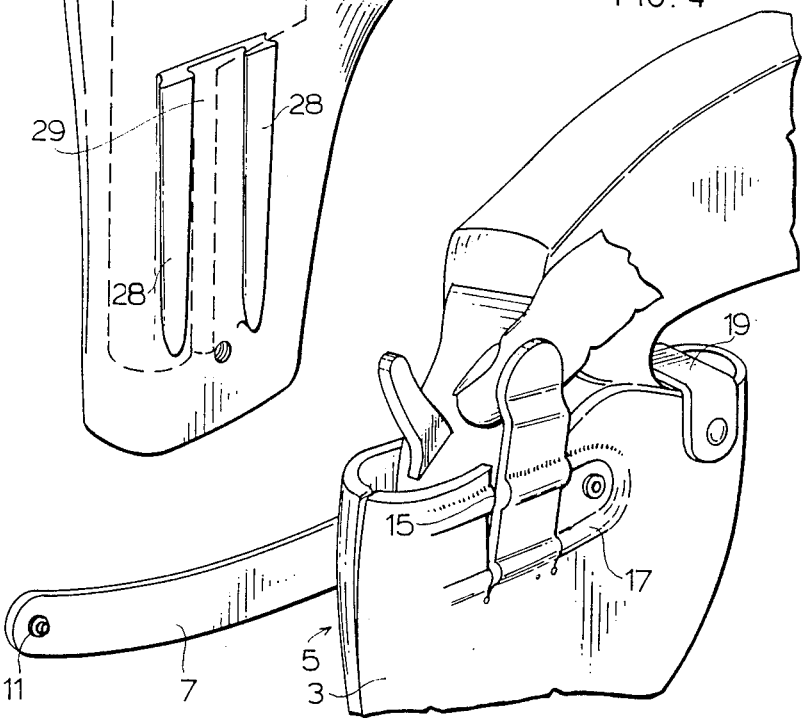
FIG. 4 is further enlarged perspective view showing the release mechanism from the holster of FIG. 3.

In order to fit the gun into the holster, strap 7 must first be removed as shown in FIG. 4 of the drawings to allow separation of the casing at its front end so that the revolver can be dropped down into position where strap 19 sits immediately over the trigger guard of the revolver as seen in FIG. 3 of the drawings. Strap 7 is then snapped into its secured position as seen in FIG.3 such that the revolver cannot be withdrawn from the holster without first releasing strap 7. The reason that the revolver is secured in this manner is so that it cannot be removed or at least easily removed by someone other than the person, e.g. typically an officer or security guard, wearing the holster. For example, it is important that if the officer or guard is wrestling or fighting with an intruder, that intruder must not be able to use the officer's own revolver against him.

The only way that the revolver can be withdrawn from the holster is by first releasing strap 7 by means of a strap release 13. Release 13 is an integral part of the casing and comprises a plastic piece upstanding from the remainder of the casing as shown in the drawings. The casing is cut or slit as indicated at 15 down along the sides of the thumb release to a depth below the position at which strap 7 is secured to the inside of the casing. Therefore, by applying an outward force on release 13, it then pushes on strap 7 and snaps the releasable end 11 of the securing strap off of the casing. Note that the strap release has an upward inward bend over the holster at its upper end providing increased leverage for operation of the release.

As best seen in FIG. 4 of the drawings, the casing is built up as indicated at 17 around the end 11 of the strap. This effectively provides an embedding of the strap into the casing making the strap itself inaccessible so that the only way that it can be released is by applying an outward force on release 13 rather than being able to grap the strap itself which is inaccessible because of the build up of the casing around it.

A very important part of the present invention is that release 13 be made as an integral part of the plastic casing and because it is formed from the same plastic it has the same characteristics as the remainder of the holster. This ensures its accuracy of operation with each and every releasing of the strap. As a further preferred embodiment, the thumb release can be reinforced as for example by a spring steel insert or the like built right into the release.

The integral construction of the release formed as part of the holster also eliminates the requirement for add on pieces which can adversly affect accurate positioning of the release relative to the strap, adversly increase bulk of the holster and which can further come loose from the holster. Because the release of the present invention is part of the holster there are no misalignment problems relative to the strap and further the strap is allowed to sit flat against the side of the holster for a positive snap fit to the holster. This is to be contrasted to an add on piece which would cause the strap, because of the additional thickness of the add on piece, to start in a position already pushed out away from the holster and not allow as positive a lock to the holster as is found with the present invention.

Figure 7:
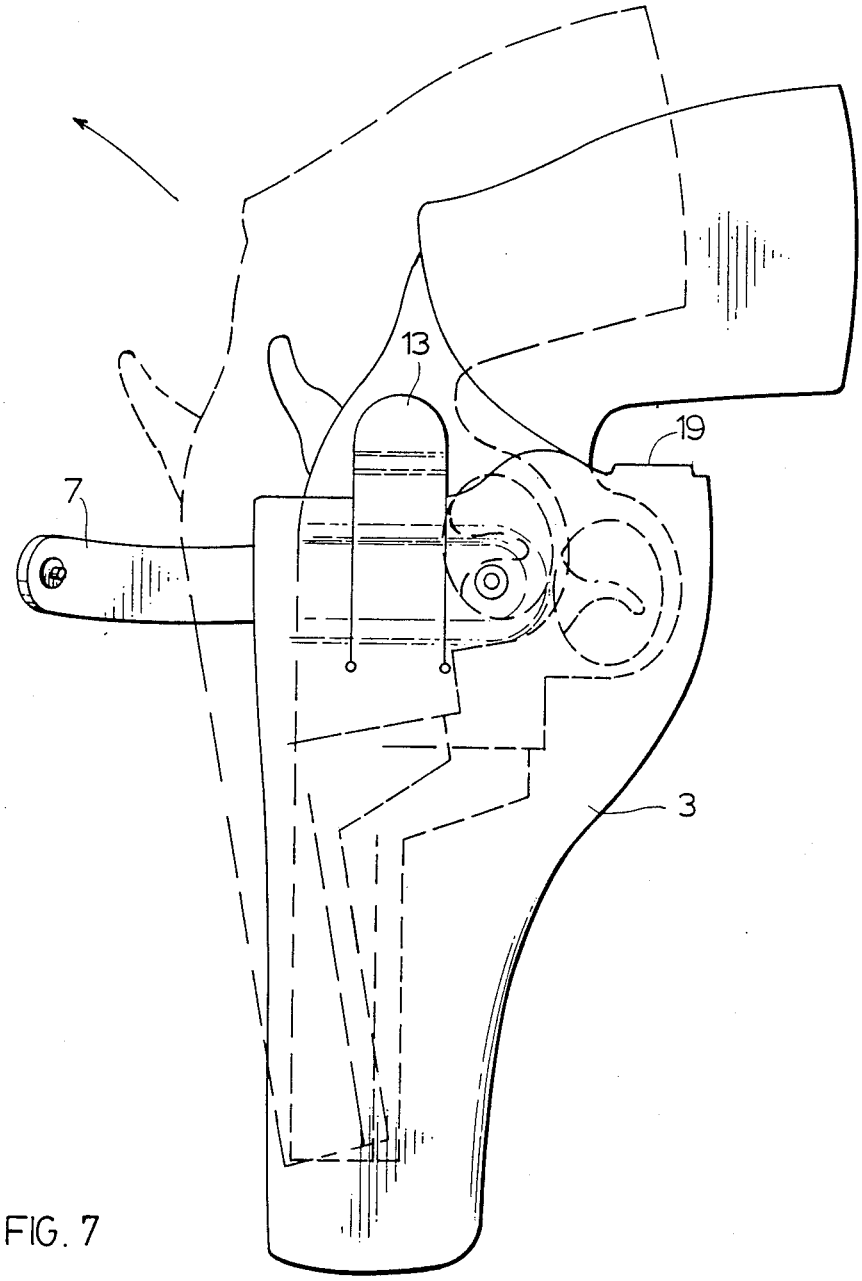
FIG. 7 is an inside plan view of the holster of FIG. 1 with the revolver being withdrawn from the holster.

Positioning of the release on the casing is such that an officer when reaching for the revolver places his or her hand on the butt of the revolver with the thumb then being positioned on the thumb release. The officer then through the thumb release applies an outward pressure to release strap 7 and allowing the revolver rather than having to be pulled upwardly out of the holster to simply be rocked or pivoted forwardly at its upper end through the break open front to then allow the gun barrel to be drawn forwardly through the already released front end of the holster as shown in FIG. 7 of the drawings. Again, because of the hand positioning, the forefinger goes immediately to the trigger so that with practice the entire maneuver is accomplished extremely quickly.

Figure 2:
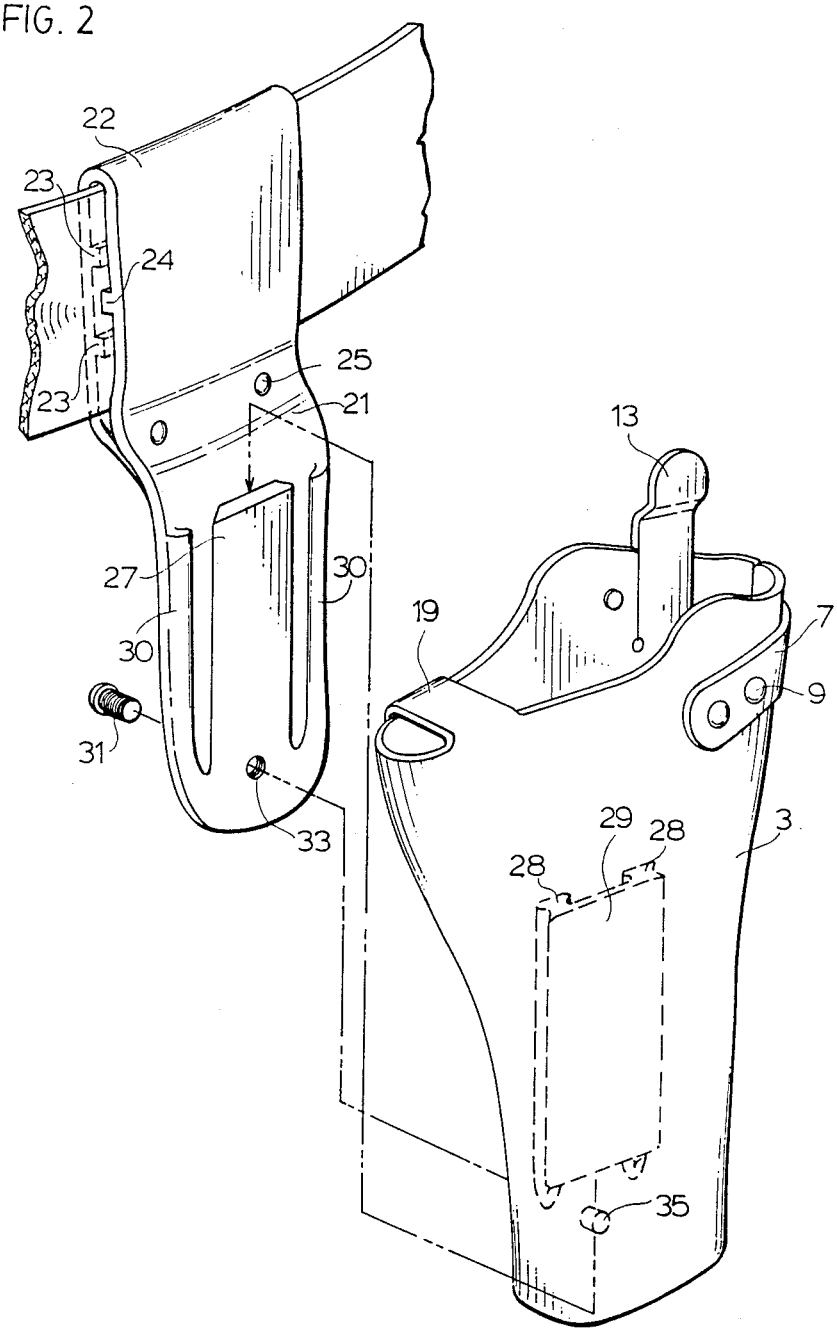
FIG. 2 is a further perspective view of the holster of FIG. 1 when removed from the belt attachment for supporting the holster.

The description above relates particularly to the casing for holding the revolver. It is also important that the casing be secured to the waist belt by effective mounting means. Such a mounting means is seen in FIG. 2 of the drawings in the form of a belt clip 21. This belt clip has a top loop 22 which is secured around the belt by means of rivets or screws 25. The lower part of clip 21 is provided to its outside face with an undercut lug 27. The casing is in turn provided with undercut notched region 29 having undercut leg portions 28. This set up allows the casing to be simply slipped down onto stud 27 for a firm interlock in notched region 29 the legs of which engage in an undercut fashion with outside legs 30 of the clip 21. This interlock is then secured by means of a small screw 31 fitting through opening 33 in the clip and then threading into opening 35 on the casing. As will be appreciated, the casing and the clip can easily be disassembled by first removing screw 31 and then pulling the casing upwardly off of the clip.

As will be seen in FIGS. 2 and 5, loop 22 includes interior ridges 23 and 24. These ridges as shown bite on the belt to which the loop is fitted and cause the belt to bend interiorly of the loop. This provides a very positive grip so that the clip and the holster do not slip on the belt.

Again, in the preferred embodiment, clip 21 has the same plastic construction as that of casing 3.

Although various preferred embodiments of he invention have been described in datail, it will be appreciated that variations may be made without departing from the spirit of the invention or the scope of he appended claims.

The embodiments of the invention in which an exclusive property or privilege is claimed are defined as follow:

1. A gun holster having a casing with an interior region for receiving a revolver and having a break open front for drawing the revolver out of said casing, said casing having a unitary plastic construction and being provided with a strap which wraps from side to side of said casing across and securing said break open front, said strap having one end releasably secured to said casing and said casing being provided with a strap release for pushing said one end of said strap off of said casing thereby enabling the breaking open of said front of said casing when drawing the revolver therefrom, said strap release forming part of said unitary plastic construction and comprising a plastic piece upstanding from said casing with cuts downwardly into said casing to either side of said plastic piece for movement of said plastic piece relative to said casing, said strap being positioned outwardly of said strap release such that said strap release is located between said strap and said interior region of said holster.

2. A gun holster as claimed in claim 1, wherein said plastic piece forming said release has an upper end region bent inwardly over said casing away from said strap.

3. A gun holster as claimed in claim 1, wherein said casing including said strap release has a flattened exterior surface and wherein said strap fits flatly outwardly against said casing over said strap release.

* * * * *